US007493673B2

(12) United States Patent
Garrett

(10) Patent No.: US 7,493,673 B2
(45) Date of Patent: Feb. 24, 2009

(54) NOTCHLESS GLASS PLATE CLAMP

(75) Inventor: Rodney G. Garrett, Fort Madison, IA (US)

(73) Assignee: Custom Hardware Mfg. Inc., Keokuk, IA (US)

( * ) Notice: Subject to any disclaimer, the term of this patent is extended or adjusted under 35 U.S.C. 154(b) by 423 days.

(21) Appl. No.: 11/408,574

(22) Filed: Apr. 21, 2006

(65) Prior Publication Data

US 2007/0107351 A1 May 17, 2007

Related U.S. Application Data

(60) Provisional application No. 60/673,710, filed on Apr. 21, 2005.

(51) Int. Cl.
*E05D 5/02* (2006.01)

(52) U.S. Cl. ..... 16/252; 16/382; 16/331

(58) Field of Classification Search ..... 16/284, 16/382, 331, 332, 333, 334, 252, 341, 312; 52/282.5

See application file for complete search history.

(56) References Cited

U.S. PATENT DOCUMENTS

| | | | | | |
|---|---|---|---|---|---|
| 4,689,853 | A * | 9/1987 | Marinoni | ..... | 16/382 |
| 5,079,798 | A * | 1/1992 | Burke et al. | ..... | 16/252 |
| 5,297,313 | A * | 3/1994 | Brin | ..... | 16/252 |
| 5,613,276 | A * | 3/1997 | Franz | ..... | 16/229 |
| 5,867,869 | A * | 2/1999 | Garrett et al. | ..... | 16/252 |
| 6,161,255 | A * | 12/2000 | Garrett | ..... | 16/284 |
| 6,434,905 | B1 | 8/2002 | Sprague | | |
| 6,912,818 | B2 | 7/2005 | Sprague | | |
| 7,010,832 | B2 * | 3/2006 | Chen | ..... | 16/252 |
| 7,188,390 | B2 * | 3/2007 | Cheng | ..... | 16/252 |

* cited by examiner

*Primary Examiner*—Richard E Chilcot, Jr.
*Assistant Examiner*—Chi Q Nguyen
(74) *Attorney, Agent, or Firm*—McKee, Voorhees & Sease, P.L.C.

(57) ABSTRACT

An apparatus and method for clamping a panel, such as a glass panel, with no notch or drilled hole. The apparatus includes a base and two opposite opposing clamp halves. The lower edges of the clamp halves have downwardly extending cam surfaces. Inwardly extending arms are formed near the bottom of the clamp halves. A retainer is positionable above the arms and base. A machine screw is turned to pull the retainer to pull the arms towards the base and force the cam surfaces against the base. This causes convergence of the clamp halves by the geometry of the cams.

17 Claims, 5 Drawing Sheets

NOTCHLESS GLASS PLATE CLAMP

CROSS-REFERENCE TO RELATED APPLICATIONS

This application claims priority under 35 U.S.C. §119 of a provisional application Ser. No. 60/673,710 filed Apr. 21, 2005, which application is hereby incorporated by reference in its entirety.

BACKGROUND OF THE INVENTION

1. Field of the Invention

The present invention relates to a clamp for plate glass or similar panels, and in particular, a clamp that does not require a notch or drilled hole in the glass plate or panel.

2. Problems in the Art

Solid plate glass pieces require some sort of mounting hardware. For substantial-sized glass plate, the weight and fragility of the glass require special hardware.

In the case of one quarter inch thick glass plate shower doors, for example, traditionally notches are cut along one side, one notch for each mounting hardware or hinge. Part of the clamp or hinge body fits within the notch to help support the substantial weight of the glass plate relative to the hinges; in other words to prevent the glass plate from slipping downward by gravity.

An example of such a hinge and notched glass plate can be found at U.S. Pat. No. 5,867,869 and U.S. Pat. No. 6,161,255, which are incorporated by reference herein. In those instances, the mounting hardware is actually a hinge which would allow the glass plate to pivot.

While these types of arrangements work well, they come at a price. The cost to cut out notches can be a substantial amount of the cost of both the glass plate and hinges. Additionally, if the notches are not cut correctly or the cutting process cracks or chips the glass, the whole glass plate must be discarded.

One alternative approach is to drill holes along one side of the glass plate instead of cutting out notches. However, the same issues exist. The drilling process can chip or crack the glass. Also it is a post-processing step that costs a substantial amount.

Therefore, there is a need for improvement in the art.

SUMMARY OF THE INVENTION

It is therefore a principle object, feature, advantage, or aspect of the present invention to provide an apparatus and method which improves upon or solves problems and deficiencies in the art.

For example, certain objects, features, aspects, or advantages of the invention include an apparatus or method which:

a. eliminates cutting notches or drilling holes in the glass panel or plate;

b. provides sufficient secure clamping pressure, even for relatively large plate glass or other high mass panels;

c. retains the clamping pressure and is robust over normal environmental conditions and lifetimes;

d. is relatively economical to make;

e. is flexible in design, for example, it can be scaled up or down for different sized panels and adapted for different applications, including holding panels in one position or in hingeable relationship to other structure.

These and other objects, features, advantages, or aspects of the present invention will become more apparent with the accompanying specification and claims.

In one aspect of the invention, a clamp includes a base having a first surface. First and second clamp halves have inner-facing clamping surfaces. Extending from the bottom of the clamp half are cam surfaces. Extending laterally near the cam surfaces are lateral arms. A retainer fits on top of the lateral arms. A machine screw or other cinching structure connects the retainer relative to base. Operation of the machine screw or cinching mechanism, to pull the retainer towards the base, applies pressure to the cams on each clamping half causing the clamping halves to converge.

A method according to one aspect of the invention comprises extending camming surfaces from the bottom of first and second clamping halves and pulling those clamping halves to cause the camming surfaces to cause clamping action.

DETAILED DESCRIPTION OF AN EXEMPLARY EMBODIMENT OF THE PRESENT INVENTION

Figure 1:
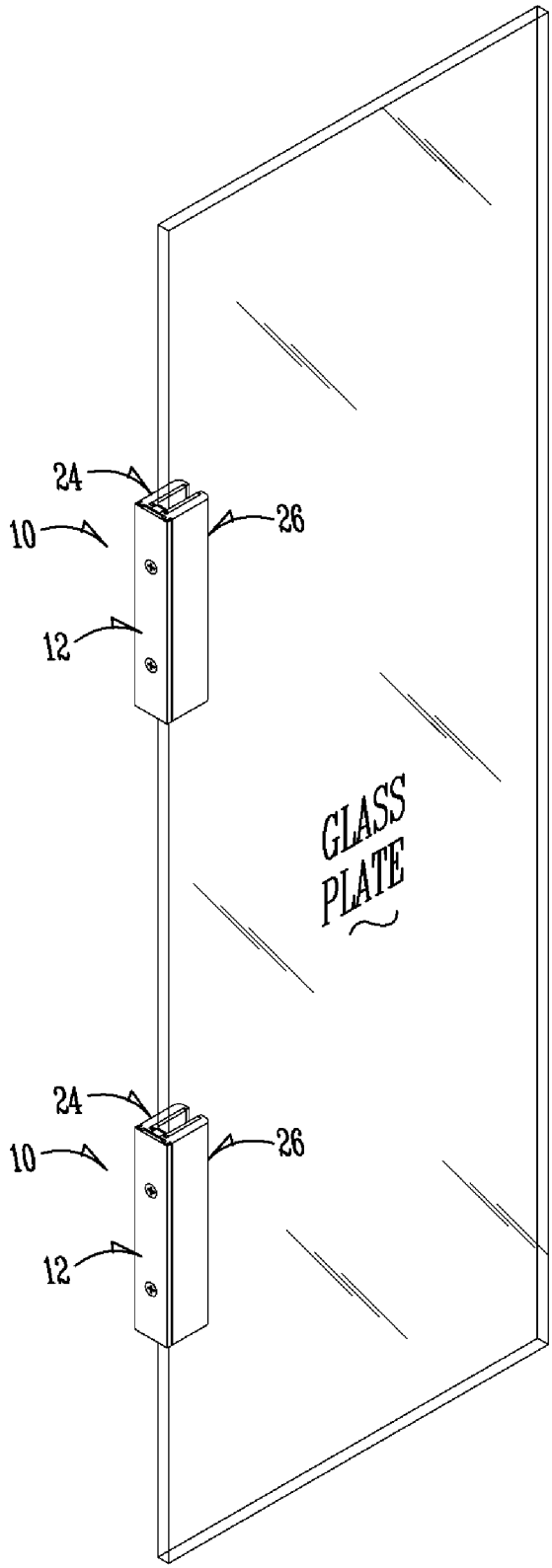
FIG. 1 is a perspective view of a pair of clamps according to an exemplary embodiment of the present invention installed on a glass panel or plate.

For a better understanding of the invention, one example of a form the invention can take will now be described in detail. Frequent reference will be made to the appended drawings. Reference numerals will be used to indicate certain parts and locations in the drawings. The same reference numerals will be used to indicate the same parts and locations throughout the drawings unless otherwise indicated.

FIG. 1 shows in perspective an exemplary embodiment, namely glass clamp 10, clamping a one quarter inch glass plate shower door along its side. There are actually two clamps 10, one nearer the top, one nearer the bottom. It is to be understood that each clamp engages along the continuous side edge of the plate and that no notch or drilled hole is in the glass plate (see FIG. 2).

It is to be understood that clamp 10 could be used either just to hold the glass plate in a static position or could be combined with other structure to form one half of a hinge. Reference to incorporated by reference U.S. Pat. Nos. 5,867,869 and 6,161,255, provide examples of how the hinge could be formed and be secured to a door frame or wall.

Clamp 10 is designed to provide sufficient clamping force on opposite sides of the glass plate such that it could suspend it over a normal time span without failure. In other words, it should hold the glass plate without allowing it to slip for an indefinite period of time.

The specific structure to accomplish this is as follows.

Figure 2:
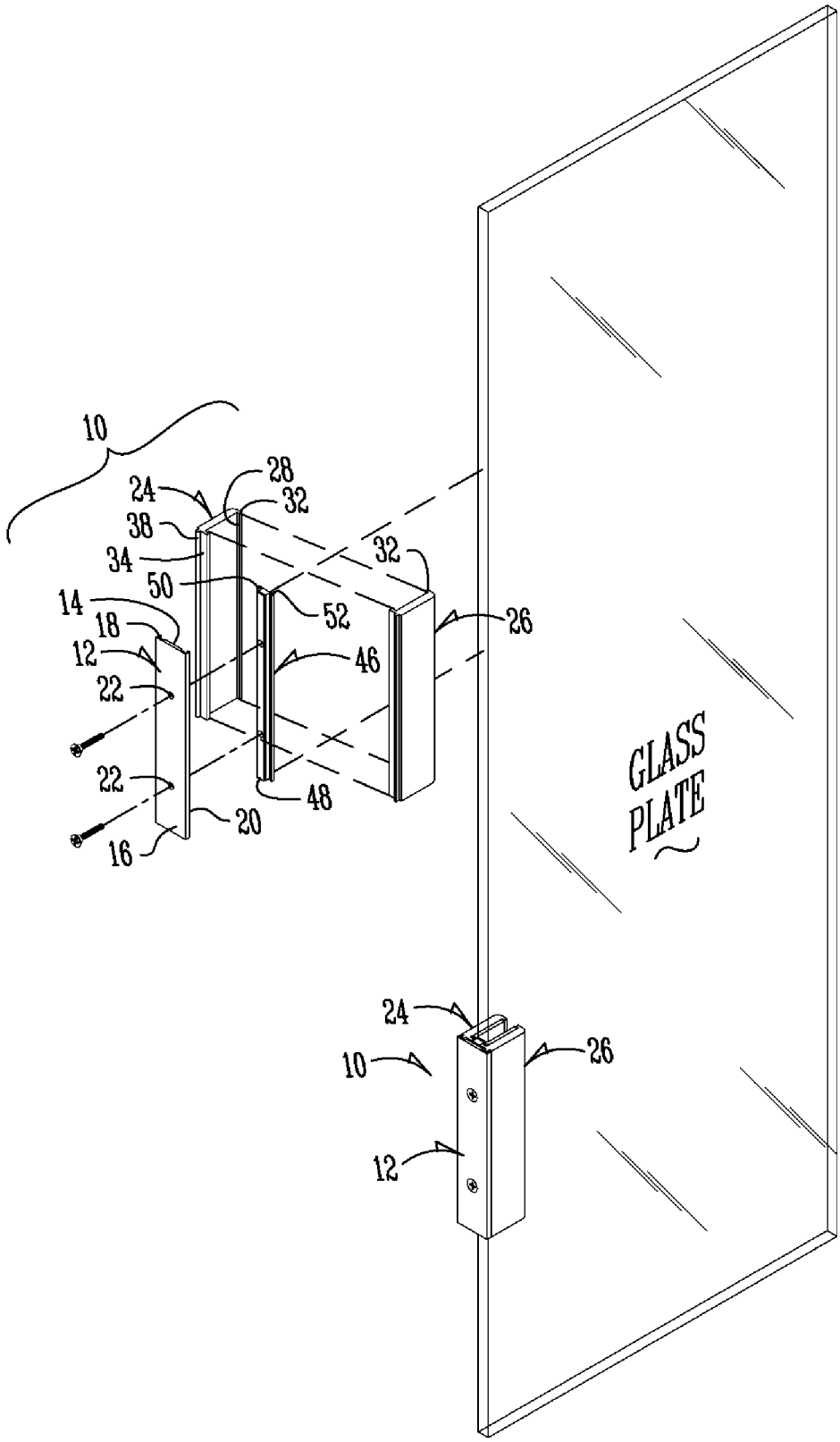
FIG. 2 is an exploded view of one of the clamps of FIG. 1.

FIG. 2 illustrates an exploded form the basic parts of one clamp 10. A base 12 is elongated along a longitudinal axis. It has a top surface 14, bottom surface 16, and opposite side flanges 18 and 20. A counter-sunk bore 22 extends through it in two positions. In this embodiment, base 12 is made from extruded metal, e.g., brass or brass alloy. Exemplary proportions for the various parts of clamp 10 are illustrated in the figures.

Clamp 10 has two opposing clamp halves 24 and 26. They are mirror images of one another. Therefore, for brevity, only one clamp half will be described in detail.

Clamp half 24 has an inner-facing side 28 and an outer side 30. An upper edge extends inwardly (see reference numeral 32). An arm or ledge 34 extends inwardly. Between the upper edge 32 and lower arm 34 is essentially formed a gasket pocket (see FIG. 3).

Figure 3:
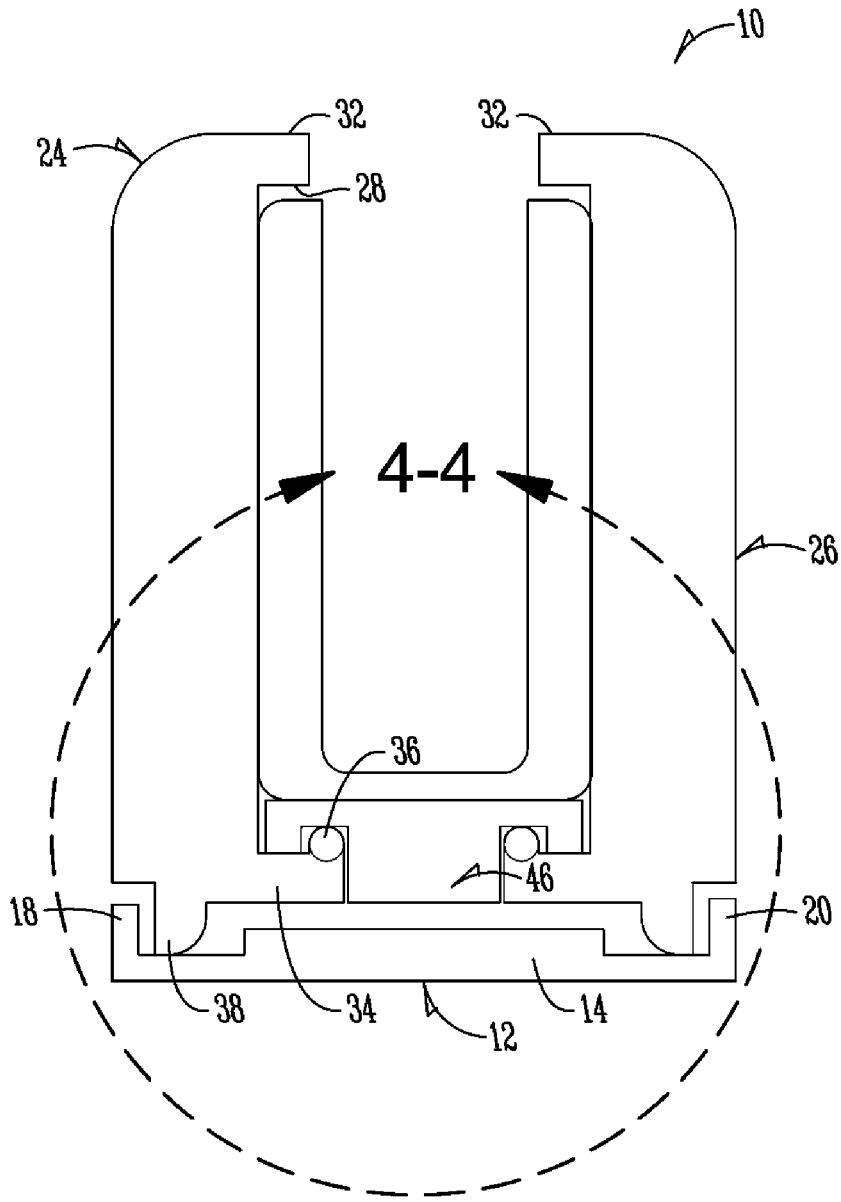
FIG. 3 is an end elevation of a clamp of FIG. 1.

Lower arm 34 includes an upwardly extending rounded lip 36 (see FIG. 3).

Extending downwardly from the bottom of clamp half 24 is what will be called a cam wall 38. It extends, in this embodiment, all the way along the bottom of clamp half 24 but is inset slightly from the outer side 30. It has a curved, inner-facing surface which functions as a cam surface, as will be described further below.

A unitary U-shaped-in-cross-section gasket 40 includes a first side 42, a second side 43, and an intermediate portion 44 (see FIG. 3). A gasket 40 fits into each respective gasket pocket in the clamping halves 24 and 26 with the intermediate portion extending therebetween. The edge of the glass panel therefore fits inside the U-shaped gasket 40.

A retainer 46 has a center portion 48 with left and right outwardly extending members 50 and 52. A blind, threaded bore 54 extends partially through the center portion 48 of retainer 46.

Figure 4:
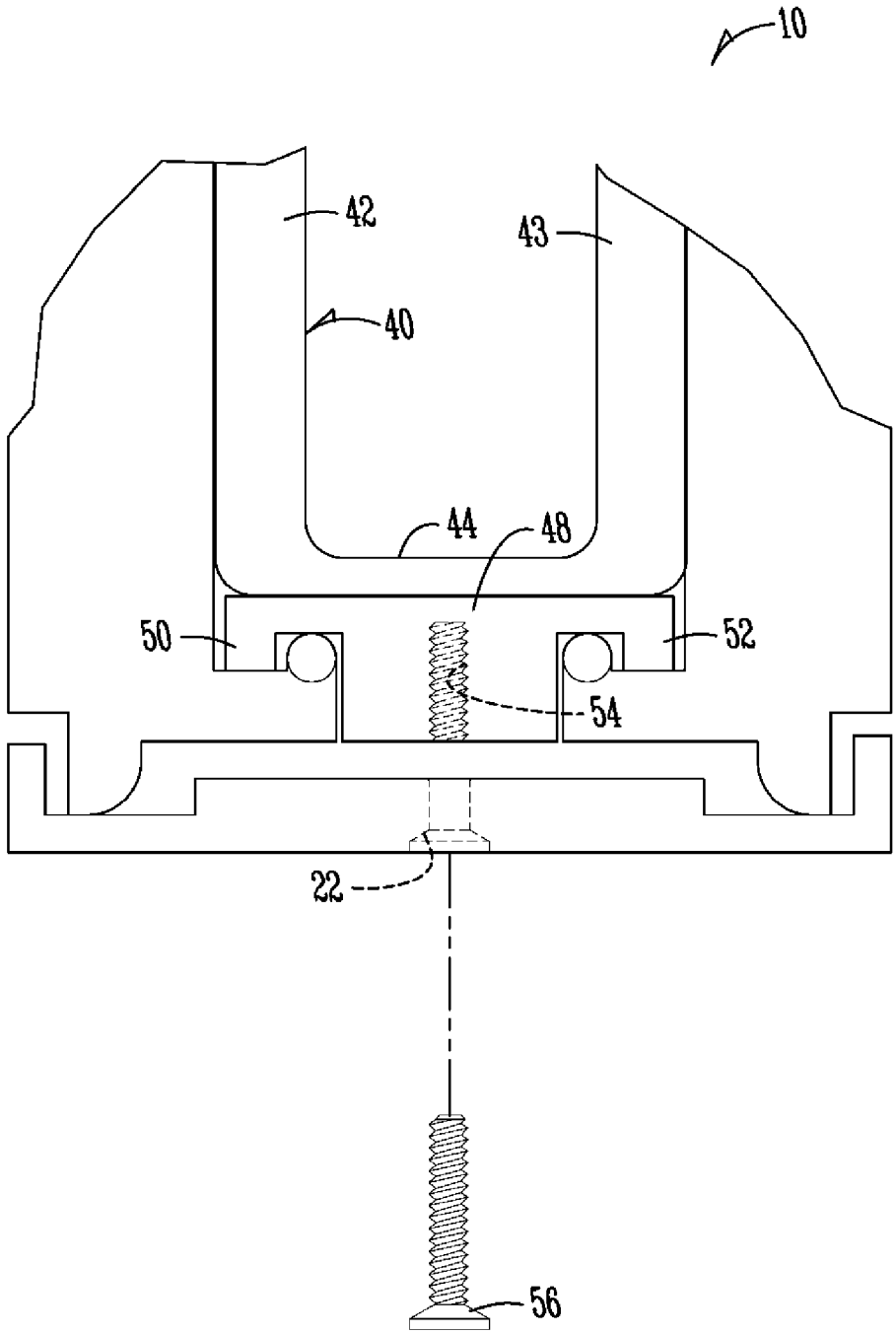
FIG. 4 is an enlarged detail taken along line A of FIG. 3.
Figure 6:
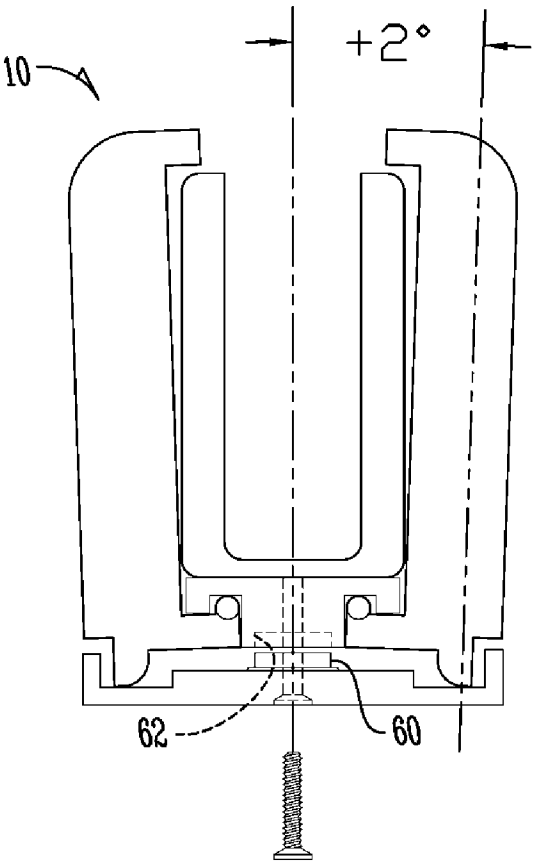

Referring now to FIGS. 3 and 4, operation of clamp 10 will be described. As illustrated in FIG. 6, when clamp 10 is preliminarily assembled, clamp halves 24 and 26 can be splayed outwardly. Hex head machine screw 56 extends through counter-set bore 22 and blind bore 54. Retainer 46 holds clamp halves 24 and 26 relative to base 12. This allows clamp 10 to be slid over the edge of the glass plate.

Figure 5:
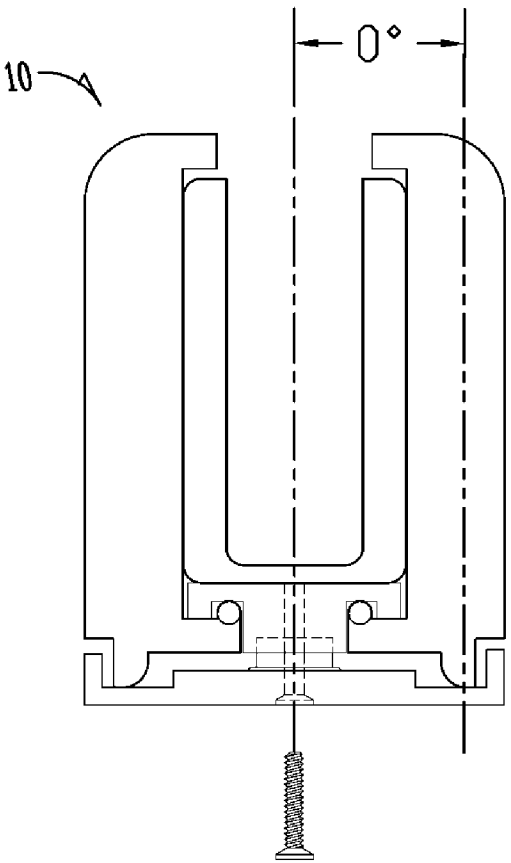

As indicated at FIG. 5, turning machine screw 56 into blind bore 54 pulls retainer 46 towards base 12. This, in turn, puts downward force on both arms 34. In turn, this forces cams 38 against the upper surface of base 12. These forces urge clamp halves 24 and 26 to converge (see FIG. 5). In turn, this would cause clamping action on glass plate.

Figure 7:
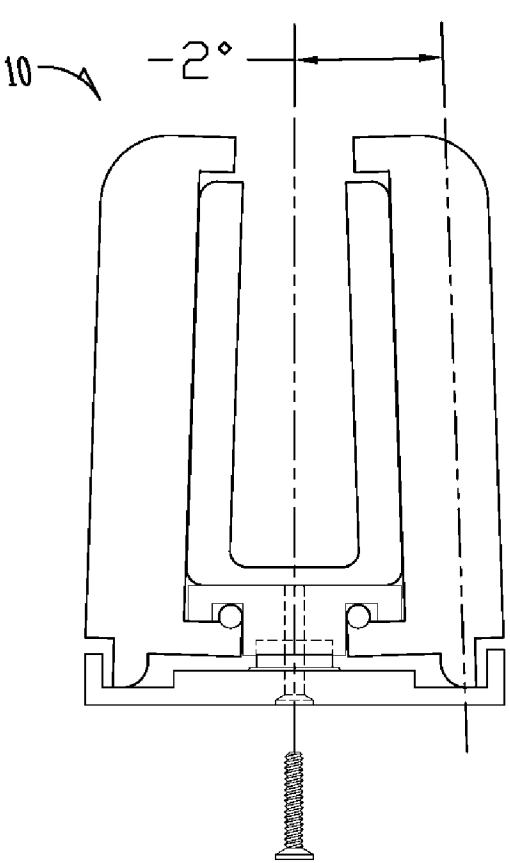
FIGS. 5-7 are alternative views from the same perspective as FIG. 3 showing the clamping action of the device.

FIG. 7 shows, in exaggerated form, that further turning of machine screw 56 will cause further convergence of clamp halves 24 and 26. By selecting the appropriate amount of force, a secure clamp on the glass plate is accomplished.

To release clamp 10, machine screws 56 merely have to be backed out sufficiently that the clamping action is released enough that clamp 10 can be slid off of the glass panel.

OPTION AND ALTERNATIVES

The exemplary embodiment is but one form the invention can take. Variations obvious to those skilled in the art will be included within the invention.

For example, the precise dimensions and configurations can vary while staying within the scope of the invention. The size can be scaled up or down depending on application.

In the drawings, the hinge is several inches long. It is possible to make it very long because no notches or holes are required in the glass. There could be one continuous clamp along the whole edge or a substantial portion of the edge. It can be extruded and cut to a variety of lengths.

Also, as previously mentioned, clamp 10 could be one-half of a pivot or hinge.

The clamps could be placed along the top and bottom edges of the glass plate, respectively, instead of alone one side.

Clamp halves 24 and 26 are brass or other suitable metal, as is retainer 46. Gasket 40 can be any suitable material that will be durable and withstand the pressures needed for clamping the glass plate. It can be used for glass shower doors, side lights, and analogous uses. For example, it could be used for building doors.

Optionally, there can be a projection 60 from base 12 that mates into a complementary counter-sunk blind bore 62 in member 46 to keep member 46 aligned relative to base 12 (see FIGS. 5-7).

What is claimed is:

1. A panel clamp comprising:

a. a base having a longitudinal axis and a first surface with spaced-apart cam abutment locations on opposite sides of the longitudinal axis;

b. opposed clamp halves each having:

i. a cam surface adapted to abut a corresponding cam abutment location on the first surface of the base;

ii. a clamping surface adapted to abut a side of a panel positioned between opposed clamp halves;

iii. an arm extending closer to the longitudinal axis of the base than the cam surface;

c. a retainer deposed on an opposite side of arms from the base; and d. a cinching mechanism connected between the base and the retainer adapted to pull the arms toward the base to rotate the opposed clamp halves on the cam surfaces to cause clamping action.

2. The panel clamp of claim 1 wherein the base further comprises a structure for mounting the base to a support.

3. The panel clamp of claim 2 wherein the support comprises a door jam.

4. The panel clamp of claim 2 wherein the support is a floor or ceiling.

5. The panel clamp of claim 1 wherein the panel comprises a glass panel or plate.

6. The panel clamp of claim 5 wherein the glass panel or plate is a shower door.

7. The panel clamp of claim 5 wherein the glass panel or plate is an interior or exterior building door.

8. The panel clamp of claim 1 wherein the longitudinal axis is several inches long.

9. The panel clamp of claim 1 further comprising a gasket deposed adjacent a clamping surface of a clamp halve to abut a side of a panel.

10. A clamp for gripping the edge of a glass plate without needing a notch or hole in the glass plate comprising:

a. first and second clamp halves having opposed glass plate clamping surfaces in generally first and second spaced-apart planes defining a glass plate clamping region, opposed extensions with edges extending inwardly towards each other from the two planes; and opposed cam edges extending in generally the same direction from the same side of each clamp halve and on outside sides of the two planes;

b. a base plate having a surface into which the cam edges come into abutment;

c. a member positioned from the base plate relative to the edges of the opposed extensions;

d. a cinching mechanism between the base plate and the member that, when operated, moves the member towards the base plate which, in turn, moves the clamp halves on the cam edges to provide clamping action.

11. The clamp of claim 10 in combination with a glass plate.

12. The combination of claim 11 wherein the glass plate is a transom.

13. The combination of claim 11 further comprising a second clamp adapted for use on the glass plate.

14. The combination of claim 11 wherein the glass plate comprises a door.

15. The combination of claim 14 wherein the door is a building door.

16. The combination of claim 14 wherein the door is a shower door.

17. The clamp of claim 10 further comprising a hinge between the clamp halves and the base plate.

* * * * *

UNITED STATES PATENT AND TRADEMARK OFFICE

CERTIFICATE OF CORRECTION

PATENT NO. : 7,493,673 B2
APPLICATION NO. : 11/408574
DATED : February 24, 2009
INVENTOR(S) : Rodney G. Garrett It is certified that error appears in the above-identified patent and that said Letters Patent is hereby corrected as shown below:

Col. 4, Claim 1, Line 21:
Delete after retainer "deposed"
Add after retainer --disposed--

Col. 4, Claim 9, Line 42:
Delete after gasket "deposed"
Add after gasket --disposed--

Signed and Sealed this

Ninth Day of June, 2009

John Doll

JOHN DOLL
*Acting Director of the United States Patent and Trademark Office*